US010724522B2

(12) United States Patent
De Bock et al.

(10) Patent No.: US 10,724,522 B2
(45) Date of Patent: Jul. 28, 2020

(54) SCREW COMPRESSOR, COMPRESSOR ELEMENT AND GEARBOX APPLIED THEREBY

(71) Applicant: ATLAS COPCO AIRPOWER, NAAMLOZE VENNOOTSCHAP, Wilrijk (BE)

(72) Inventors: Simon Peter G. De Bock, Wilrijk (BE); Johan Nachtergaele, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 323 days.

(21) Appl. No.: 15/566,135

(22) PCT Filed: Apr. 12, 2016

(86) PCT No.: PCT/BE2016/000017
§ 371 (c)(1),
(2) Date: Oct. 12, 2017

(87) PCT Pub. No.: WO2016/164989
PCT Pub. Date: Oct. 20, 2016

(65) Prior Publication Data

US 2018/0112664 A1 Apr. 26, 2018

(30) Foreign Application Priority Data

Apr. 17, 2015 (BE) ..... 2015/5250
Jun. 26, 2015 (BE) ..... 2015/5396

(51) Int. Cl.
*F04C 18/16* (2006.01)
*F04C 29/00* (2006.01)
(Continued)

(52) U.S. Cl.
CPC ..... *F04C 18/16* (2013.01); *F04C 18/086* (2013.01); *F04C 29/005* (2013.01);
(Continued)

(58) Field of Classification Search
CPC ..... F04C 18/086; F04C 18/16; F04C 29/04
See application file for complete search history.

(56) References Cited

U.S. PATENT DOCUMENTS 4,767,284 A * 8/1988 Shiinoki ..... F04C 18/16 417/312
6,663,366 B2 * 12/2003 Okada ..... F04C 29/04 418/101
(Continued)

FOREIGN PATENT DOCUMENTS

DE 102004057255 A1 8/2005
FR 773311 A * 11/1934 ..... F04C 18/086
(Continued)

OTHER PUBLICATIONS

International Search Report (ISR) dated Sep. 13, 2016, for PCT/EP2016/000017.

*Primary Examiner* — Mary Davis
(74) *Attorney, Agent, or Firm* — Bacon & Thomas, PLLC

(57) ABSTRACT

A screw compressor comprising a compressor element with a housing in which two helical rotors are mounted on bearings by their shafts, and a gearbox—with a housing with a mounting surface that is built onto a mounting surface of the housing of the compressor element, and which is coupled in a torque-transmitting way to a shaft of at least one of the aforementioned rotors, whereby the compressor element is provided with an oil circuit with an input and an output for oil and a cooling jacket with an input and output for a coolant, wherein the aforementioned inputs and outputs for the oil and for the coolant are located in the aforementioned mounting surface of the housing of the compressor element,
(Continued)

whereby these inputs and outputs connect to channels for the respective supply and removal of the oil and the coolant.

20 Claims, 3 Drawing Sheets

(51) Int. Cl.
*F04C 18/08* (2006.01)
*F04C 29/02* (2006.01)
*F04C 29/04* (2006.01)

(52) U.S. Cl.
CPC ..... *F04C 29/025* (2013.01); *F04C 29/04* (2013.01); *F04C 2240/50* (2013.01)

(56) References Cited

U.S. PATENT DOCUMENTS

| | | | | |
|---|---|---|---|---|
| 2006/0029510 | A1 | 2/2006 | Shiromaru et al. | |
| 2009/0208357 | A1* | 8/2009 | Garrett ..... | F04C 2/18 418/152 |
| 2015/0023826 | A1 | 1/2015 | Desiron | |

FOREIGN PATENT DOCUMENTS

| | | | |
|---|---|---|---|
| FR | 773311 | A | 11/1934 |
| FR | 986715 | A | 8/1951 |
| JP | 2007262925 | A | 10/2007 |
| JP | 2009127424 | A | 6/2009 |
| JP | 4732833 | B2 | 7/2011 |
| JP | 2015508858 | A | 3/2015 |
| KR | 20120054061 | A | 5/2012 |

* cited by examiner

SCREW COMPRESSOR, COMPRESSOR ELEMENT AND GEARBOX APPLIED THEREBY

The present invention relates to a screw compressor and a compressor element and a gearbox thereby applied.

BACKGROUND OF THE INVENTION

Known screw compressors are composed of a compressor element that is built onto a gearbox.

The compressor element is provided with a housing in which two helical rotors are mounted by their shafts on bearings that are lubricated by oil, to which end the compressor element is provided with an oil circuit with an input and an output for the oil.

The compressor element is also provided with a cooling jacket with an input and output to be able to circulate a coolant through the cooling jacket in order to be able to cool the compressor element.

The gearbox is provided with a housing with an incoming shaft for the coupling to a motor or other drive and the gearbox can be coupled in a torque-transmitting way to the shaft of at least one of the aforementioned rotors.

The compressor element and gearbox are built onto one another and to this end are provided with mounting surfaces that fit together with a seal therein for the external sealing of the housings with respect to the environment.

In the known screw compressors the mounting surfaces are often of a complex shape, which makes the sealing of them relatively difficult.

The inputs and outputs for oil and coolant for the compressor element are generally connected to an external supply and output for oil and coolant by means of external pipes in the form of tubes or hoses.

A disadvantage of such external pipes is that they represent an extra cost and that they can be an extra source of failures on account of the tearing or breakage of the pipes as a result of vibrations or similar, and on account of an increased risk of leaks at the location of the seals of the connecting flanges on both ends of the pipes.

An additional disadvantage is that for the connection of each connecting flange of a pipe, a connecting surface must be machined and that means must be provided to be able to tighten the connecting flange concerned against the connecting surface.

Another disadvantage is that the pipes can sometimes hinder the maintenance or certain repairs as for example they can obstruct easy access to bolts, sensors, filters and similar with standard tools.

Another disadvantage is that the pipes take up extra space and that to build the screw compressor into a cabinet or similar, the necessary space must be provided such that the set can be made less compact.

Another disadvantage is that pipes can sometimes be connected incorrectly, for example to an input instead of an output, which can lead to serious damage when bringing the screw compressor into service.

SUMMARY OF THE INVENTION

The purpose of the present invention is to provide a solution to one or more of the aforementioned and other disadvantages.

To this end the invention concerns a screw compressor that is composed of a compressor element with a housing in which two helical rotors are mounted on bearings by their shafts, and a gearbox with a housing with a mounting surface that is built onto a mounting surface of the housing of the compressor element, and which is coupled in a torque-transmitting way to a shaft of at least one of the aforementioned rotors, whereby the compressor element is provided with an oil circuit with an input and output for oil and a cooling jacket with an input and output for a coolant, whereby the aforementioned inputs and outputs for the oil and for the coolant are located in the aforementioned mounting surface of the housing of the compressor element, whereby these inputs and outputs connect to channels for the respective supply and removal of the oil and the coolant that are at least partially integrated internally in the gearbox.

An advantage of the invention is that by assembling the compressor element and the gearbox, the suitable connections for the oil lubrication of the bearings of the compressor element and for the cooling of the compressor element are automatically brought about.

Mistakes with these connections are thus prevented.

Moreover, extra pipes are not required such that they cannot obstruct the accessibility of certain components during repair or maintenance.

Due to the absence of external pipes for the oil lubrication and cooling, a screw compressor according to the invention is more reliable as tears or breakages in the pipes cannot occur, there is less risk of leakages occurring as the number of seals is reduced by at least one half with respect to the known situation, whereby at least two seals are required for each pipe.

Moreover, a screw compressor according to the invention can be made more compact on account of the reduced number of external pipes, and fewer machine stages are required in production as no or fewer connecting surfaces have to be provided for the connecting flanges of pipes.

According to a preferred characteristic the aforementioned mounting surfaces are flat and extend in a plane that extends transversely to the axial direction of the rotors.

The mounting surfaces being flat of course simplifies the realisation of them during production and also simplifies the sealing of the housings thereof with respect to the environment and the sealing of the connections between the inputs and outputs for oil and coolant of the compressor element on the one hand, and the corresponding channels for the supply and removal of oil and coolant for the gearbox on the other hand, due to the application of flat seals or O-rings.

Preferably the seals for sealing the respective connections between the input and output for the coolant of the housing of the compressor element on the one hand, and the corresponding channels for the supply and removal of coolant from the housing of the gearbox on the other hand, are outside the periphery of the seal for sealing the housings.

In the event of a leak occurring at the location of an aforementioned seal at the input and/or output of the coolant connections, this prevents coolant being able to leak to the oil in the oil sump of the gearbox that could affect the lubricating properties of the oil and thereby could cause premature wear and breakage of the gearbox and also of the bearings of the compressor element, if, as is usual, the oil of the gearbox is also used to lubricate the bearings of the compressor element.

Preferably the seals for sealing the respective connections between the input and output for oil of the housing of the compressor element on the one hand, and the corresponding channels for the supply and removal of oil of the gearbox housing on the other hand, are located outside the seal for sealing the housings.

Preferably the output for oil of the housing of the compressor element is located below the level of the bearings of the rotors of this compressor element, such that the oil in the bearings can more easily flow away to the sump of the gearbox or similar, and the oil thus experiences less resistance when it is driven through the bearings.

Optionally two or more outputs are provided for the oil of the compressor element, so that the compressor element can be mounted in different positions on the gearbox, while there is still an output that is located below the level of the bearings and which connects to the channel of the gearbox for the removal of the oil.

In the event of the oil of the gearbox being used for the lubrication of the compressor element, preferably the channel for the removal of the oil from the compressor element leads to the oil sump of the housing of the gearbox, where the oil is received and supplied back to the compressor element by means of an oil pump via an aforementioned channel for the supply of oil to the compressor element.

In this way the oil circuit of the screw compressor is fully integrated internally.

Preferably the input and/or the output for the coolant of the compressor element are located such that this input and/or this output are approximately as low as the lowest point of the cooling jacket when the compressor element is built onto the gearbox.

From the point of view of standardisation of tools, O-rings and similar, the input and the output for the coolant of the compressor element can have the same dimensions. Moreover, the input and output can be interchangeable so that the coolant can be driven in the one or the other direction through the cooling jacket.

Letting the coolant flow via the internal channels of the gearbox also helps the cooling of the oil in the gearbox.

Preferably, there are no other connections for gas or liquid vertically below the input and/or output for the coolant of the compressor element, such that in the event of a leak at the location of such an input and/or output no mixing can occur with the oil of the screw compressor.

According to another characteristic of the invention, the mounting surfaces are provided with dowel pins and corresponding dowel holes for the alignment of the shaft of a least one of the rotors to which the gearbox is coupled in a torque-transmitting way with respect to the incoming shaft of the gearbox and/or for the alignment of the inputs and outputs for oil and coolant of the housing of the compressor element with the corresponding channels for the supply and removal of oil and coolant of the gearbox with respect to one another.

Preferably the dowel pins and dowel holes are located in a plane parallel to or coinciding with the plane through the geometric axes of the rotors of the compressor element.

An advantage of this is that the position of the dowel pins has to be accurately determined and checked during production, for example by measuring the position of the dowel holes with respect to the boreholes in the housing of the compressor element for the bearings of the rotors.

The invention also relates to a compressor element that is suitable for use in a screw compressor according to the invention as described above, whereby the housing of the compressor element is provided with a mounting surface for building onto a gearbox and whereby the compressor element is provided with an oil circuit with an input and an output for oil, and with a cooling jacket with an input and output for a coolant, whereby these inputs and outputs are located in the aforementioned mounting surface.

The invention also relates to a gearbox, that is suitable for use in a screw compressor according to the invention, whereby the housing of the compressor element is provided with a mounting surface for building onto a compressor element and whereby the housing is provided with channels for the respective supply and removal of oil and coolant to the compressor element, whereby these channels are at least partially integrated internally in the gearbox and lead to or start from the aforementioned mounting surface.

BRIEF DESCRIPTION OF THE DRAWINGS

With the intention of better showing the characteristics of the invention, a few preferred embodiments of a screw compressor according to the invention and a compressor element and gearbox thereby applied are described hereinafter by way of an example, without any limiting nature, with reference to the accompanying drawings, wherein.

DETAILED DESCRIPTION OF THE INVENTION

Figure 1:
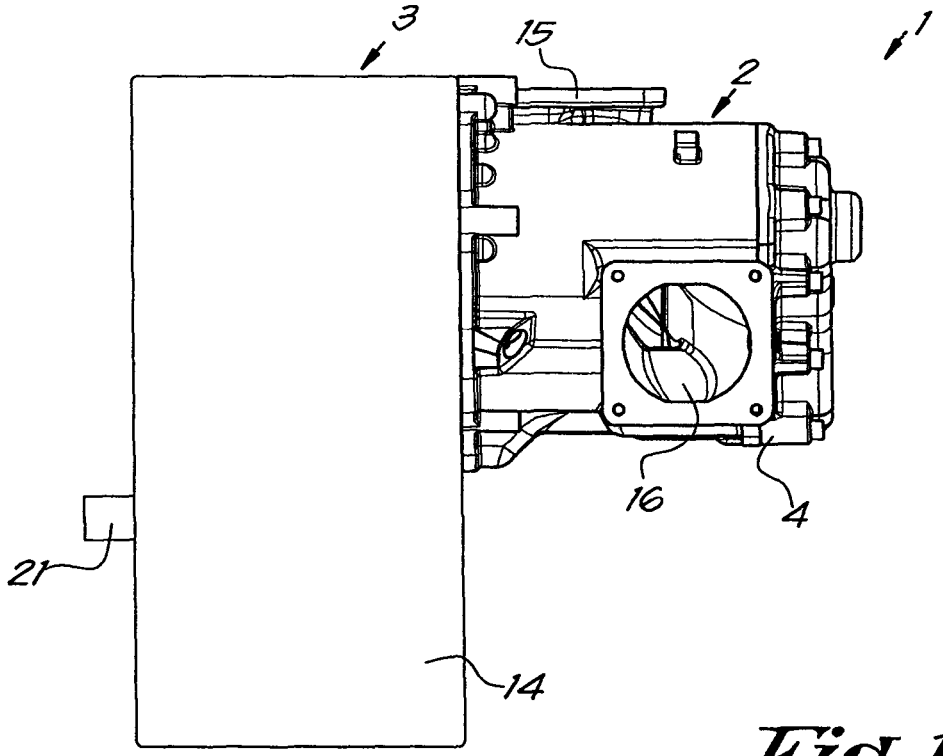
FIG. 1 schematically shows a screw compressor according to the invention with a compressor element and a gearbox according to the invention.
Figure 2:
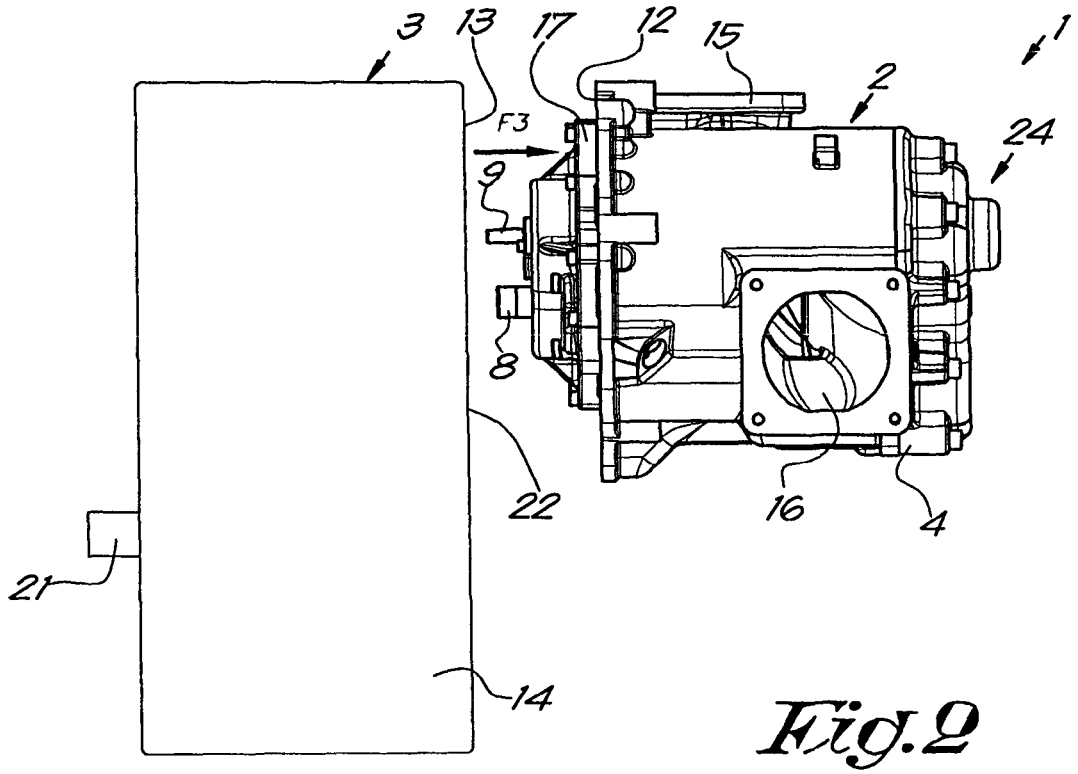
FIG. 2 shows the screw compressor of FIG. 1, but with the compressor element and the gearbox separated from one another.

The oil-free screw compressor 1 shown in FIGS. 1 and 2 is composed of a compressor element 2 and gearbox 3.

Figure 4:
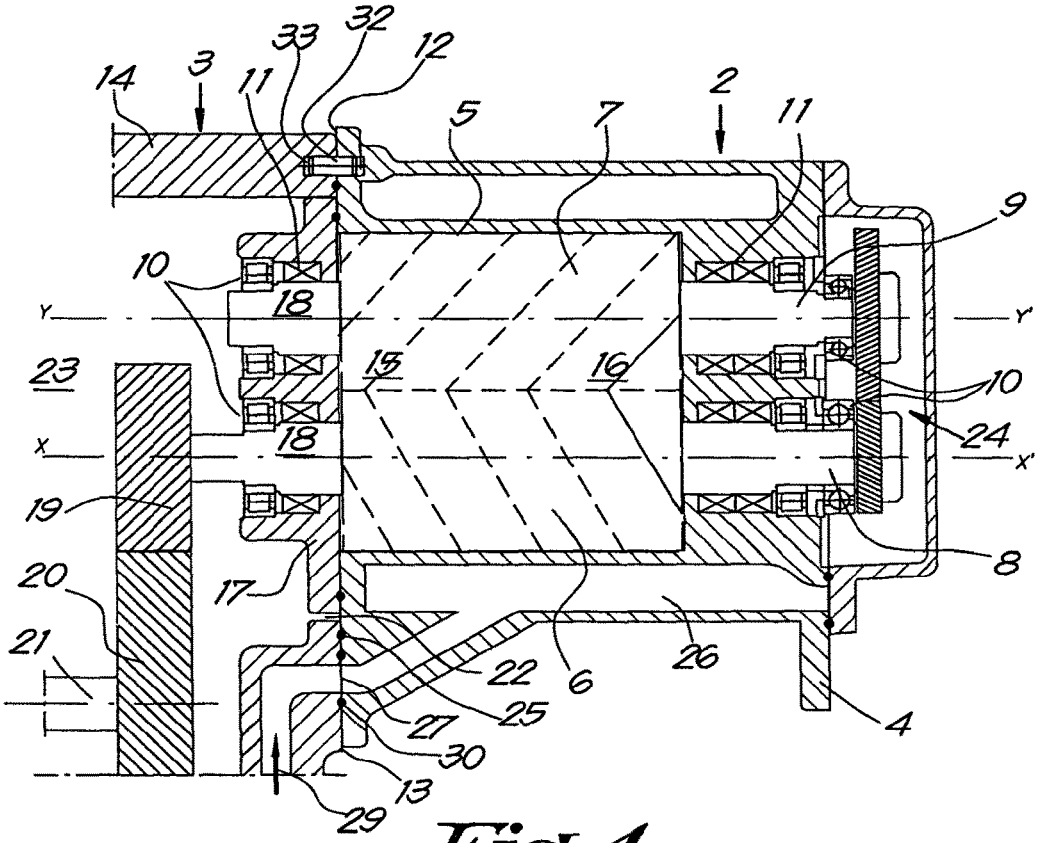
FIG. 4 shows a cross-section according to the broken line IV-IV of FIG. 3.

As shown in FIG. 4 the compressor element 2 comprises a housing 4 with two rotor chambers 5 in which helical rotors 6 and 7, respectively a male rotor 6 and female rotor 7, are mounted on bearings 10 by their respective shafts 8 and 9.

The rotor chambers 5 are sealed by means of shaft seals 11 that are affixed around the shafts 8 and 9.

The housing 4 of the compressor element 2 is provided with a mounting surface 12 by which the compressor element 2 is built onto a corresponding mounting surface 13 of the housing 14 of the gearbox 3 by means of bolts or similar not shown.

In the example shown these mounting surfaces 12 and 13 are completely flat and extend in a plane that extends transversely to the axial direction of the rotors 6 and 7.

Figure 3:
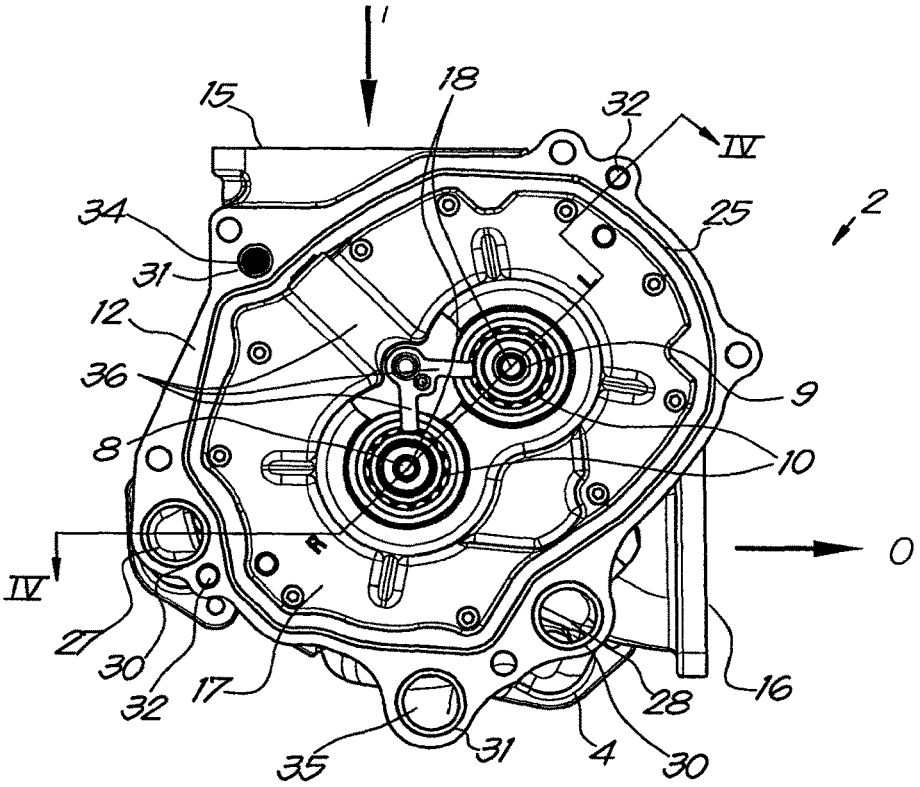
FIG. 3 shows a view according to arrow F3 in FIG. 2.

The housing 4 of the compressor element is provided with an inlet 15 on the one hand, via which inlet 15 the compressor element 2 can draw in a gas to be compressed during operation in the direction of the arrow I of FIG. 3, and an outlet 16 on the other hand, via which outlet 16 the compressed gas can be pushed away in the direction of arrow O.

In the example of the drawings, the compressor element 2 is an 'inlet driven' compressor element 2, which means that when viewed in the axial direction of the rotors 6 and 7 the inlet 15 is on the side of the gearbox 3 while the outlet 16 is located further away from the gearbox 3 than the inlet 15.

A bearing cover 17 is mounted on the mounting surface 12 of the compressor element 2 in which the bearings 10 of the shaft ends 18 of the rotors 6 and 7 are affixed on the inlet side and where the male rotor 6 protrudes by its shaft end 18, whereby this shaft end 18 is provided with a gearwheel 19 that is coupled in a torque-transmitting way to a gearwheel 20 of the gearbox 3.

The gearwheel 20 is affixed to an incoming shaft 21 of the gearbox 3 that is mounted on bearings therein, and a part of which protrudes out of the gearbox 3 for coupling to a motor or other drive not shown.

The bearing cover 17 and the shaft end 18 with the gearwheel 19 protrude, via an opening 22, into the space 23 of the housing 14 of the gearbox 3.

The aforementioned mounting surface 13 of the housing 14 of the gearbox is formed by the periphery of the opening 22 and in this way extends around the bearing cover 17 and the shaft ends 18 that are mounted on bearings therein.

Between the mounting surfaces 12 and 13 there is a ring-shaped seal 25 that extends around the bearing cover 17 and which ensures the mutual seal of the housings 4 and 14.

The female rotor 7 is driven by the male rotor 6 via a gearwheel transmission 24 at the outlet side of the compressor element 2.

The housing 4 of the compressor element 2 is provided with a cooling jacket 26 that extends around the rotor chambers 5 and which is provided with an input 27 and an output 28 that are both located in the mounting surface 12 of the compressor element 2 and which connect to channels for the supply and removal of a coolant that is at least partially internally integrated in the gearbox 3.

FIGS. 1 to 4 only show the internal channel 29 of the gearbox 3 through which channel 29 coolant can be driven through the cooling jacket 26 for cooling the compressor element during use.

In the same way the output 28 of the cooling jacket 26 connects to an internal channel, not shown, for the removal of the coolant via the gearbox 3.

The aforementioned input 27 and output 28 are each sealed by means of a seal 30, for example in the form of an O-ring that is affixed between the mounting surfaces 12 and 13, and which are affixed around the input 27 and output 28 concerned.

These O-rings can at least be partially held in a groove in one of the two or in both mounting surfaces 12 and 13.

Preferably, as in the example shown, the input 27 and output 28 are located outside the periphery of the seal 25 for sealing the housings 4 and 14.

Preferably the input 27 and/or the output 28 for the coolant are located such that this input 27 and/or this output 28 are approximately as low as the lowest point of the cooling jacket 26 when the compressor element 2 is built onto the gearbox 3, so that the cooling jacket 26 can easily be emptied for maintenance and repairs.

The input 27 and output 28 preferably have the same dimensions so that they can be mutually exchanged to enable the coolant to flow through the cooling jacket 26 in the one or the other direction.

The mounting surfaces 12 and 13 are provided with dowel pins 32 and corresponding dowel holes 33 for the alignment of the shaft 8 or 9 of the rotors 6 or 7 to which the gearbox 3 is coupled in a torque-transmitting way, with respect to the incoming shaft 21 of the gearbox 3 and/or for the alignment of the inputs and outputs 27 and 28 with the corresponding channels 29 for the supply and removal of the coolant of the gearbox 3 with respect to one another.

These dowel pins 32 and dowel holes 33 are located in a plane parallel to the plane through the geometric axes of the rotors 6 and 7 of the compressor element 2, or according to an alternative form can also coincide with this last plane.

Furthermore the housing of the compressor element 2 is also provided with an oil circuit with an input 34 that is located in the mounting surface 12 of the compressor element 2 and which connects to an internal channel, not shown, of the gearbox 3 for the supply of oil, for example by means of an oil pump from the oil sump of the gearbox 3, and with an output 35 that is also situated in the mounting surface 12 and which connects to another internal channel, not shown, of the gearbox 3 for the removal of the oil, for example back to the oil sump of the gearbox 3.

The input 34 is connected to the bearings 10 via oil channels 36 for the lubrication thereof and is located on the side of the inlet 15 of the plane going through the geometric axes of the rotors 6 and 7.

The output 35 is located below the level of the bearings 10 so that the oil can flow back to the oil sump of the gearbox 3 by the force of gravity.

The input 34 and output 35 are located outside the periphery of the seal 25 for the seal between the housings 4 and 14 and are also provided with a seal 31 in the form of an O-ring or similar.

It is clear from FIG. 3 that there are no other connections for gas or liquid vertically below the input 27 and output 28 for the coolant.

It is clear that with a screw compressor according to the invention, no external pipes are needed for the cooling and oil lubrication of the compressor element 2.

Figure 5:
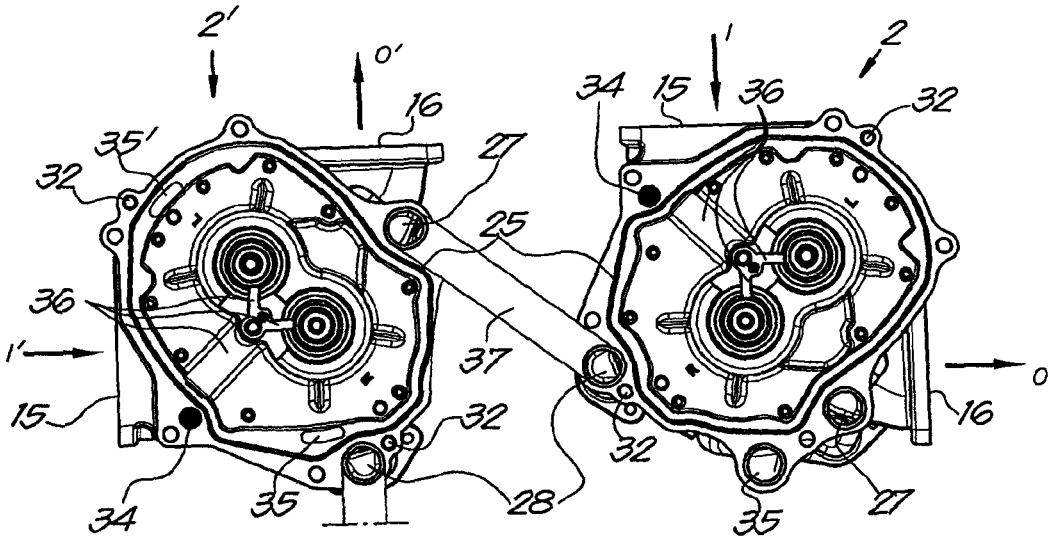
FIG. 5 shows a two-stage screw compressor with a low pressure and a high pressure compressor element according to the invention.

FIG. 5 shows a screw compressor with two pressure stages, i.e. a low pressure stage that is realised with a compressor element 2 as described above, and a high pressure stage with a compressor element 2' with primarily the same properties as the compressor element 2, but whereby this compressor element is turned approximately a quarter turn around the geometric axis parallel to the shafts 8 and 9 of the rotors 6 and 7.

Also in the case of the compressor element 2', the inputs 27 and 34 and the outputs 28 and 35 are located in the mounting surface 12 of the compressor element 2, but in this case there are two outputs 35 and 35' that are located diametrically opposite one another and which in this case are located within the periphery of the seal 25.

As a result, this compressor element 2' can be mounted in two possible positions, either with the output 35 at the bottom or with the output 35' at the bottom.

The cooling jackets 26 of both compressor elements are connected together via an internal channel 37, so that an external pipe can be saved on for this purpose.

The present invention is by no means limited to the embodiments described as an example and shown in the drawings, but a screw compressor according to the invention and a compressor element and a gearbox applied therein can be realised in all kinds of forms and dimensions, without departing from the scope of the invention.

The invention claimed is:

1. A screw compressor comprising:

a compressor unit comprising:

a compressor housing with a compressor mounting surface;

two helical rotors mounted on bearings by respective shafts;

an oil circuit with an oil input and an oil output located in the compressor mounting surface; and a coolant circuit including a coolant jacket with a coolant input and a coolant output located in the compressor mounting surface;

a gearbox comprising:

a gearbox housing having an opening, wherein a gearbox mounting surface that mates with the compressor mounting surface is formed by a periphery of the opening, wherein said opening is configured to receive both ends of the shafts of the two helical rotors;

a gear that is coupled in a torque-transmitting way to a respective shaft of at least one of the two helical rotors, wherein the gearbox housing has internally integrated channels comprising an oil supply channel, an oil removal channel, a coolant supply channel, and a coolant removal channel, and wherein the oil supply channel directly connects to the oil input and is configured to supply oil to the compressor unit, the oil removal channel directly connects to the oil output and is configured to remove the oil from the compressor unit, the coolant supply channel directly connects to the coolant input and is configured to supply a coolant to the compressor unit, and the coolant removal channel directly connects to the coolant output and is configured to remove the coolant from the compressor unit.

2. The screw compressor according to claim 1, wherein the ends of the shafts of the two helical rotors on the gearbox side are mounted on gearbox side bearings.

3. The screw compressor according to claim 1, wherein the compressor mounting surface and the gearbox mounting surface are flat and extend in a plane that extends transversely to an axial direction of the two helical rotors.

4. The screw compressor according to claim 1, wherein the compressor and the gearbox housings are sealed at a location of the compressor mounting surface and the gearbox mounting surface by a mutual housing seal that is affixed between the compressor mounting surface and the gearbox mounting surface and which extends around the bearings of the two helical rotors on the side of the gearbox.

5. The screw compressor according to claim 4, wherein the mutual housing seal between the compressor mounting surface and the gearbox mounting surface is made in the form of an O-ring that is at least partially held in a gutter-shaped groove in the compressor mounting surface and/or the gearbox mounting surface.

6. The screw compressor according to claim 4, wherein a first seal for sealing the oil input and the oil supply channel and a second seal for sealing the oil output and the oil removal channel are located outside a periphery of the mutual housing seal for the mutual sealing of the compressor housing and the gearbox housing.

7. The screw compressor according to claim 6, wherein a third seal for sealing the coolant input and the coolant supply channel and a fourth seal for sealing the coolant output and the coolant removal channel are located outside a periphery of the mutual housing seal for the mutual sealing of the compressor housing and the gearbox housing.

8. The screw compressor according to claim 1, wherein a plurality of seals is affixed between the compressor mounting surface and the gearbox mounting surface to seal the oil circuit and the coolant circuit;

the plurality of seals comprises:

a first seal that surrounds the oil input and the oil supply channel;

a second seal that surrounds the oil output and the oil removal channel;

a third seal that surrounds the coolant input and the coolant supply channel; and a fourth seal that surrounds the coolant output and the coolant removal channel.

9. The screw compressor according to claim 1, wherein the oil is provided for lubricating the bearings of the two helical rotors of the compressor unit and the output for the oil of the compressor unit is located below a level of the bearings.

10. The screw compressor according to claim 9, wherein there are at least two outputs for the oil of the compressor unit and that at least one of the two outputs is located below the level of the bearings.

11. The screw compressor according to claim 9, wherein the oil removal channel for the removal of oil from the compressor unit leads to a sump of the housing of the gearbox, where the oil is collected and is supplied to the compressor unit via the oil supply channel for the supply of oil of the gearbox.

12. The screw compressor according to claim 1, wherein the compressor unit is provided with an inlet for a gas to be compressed and an outlet for compressed gas and that the oil input of the compressor unit is located on a side of an inlet of a plane going through geometric axes of the two helical rotors of the compressor unit.

13. The screw compressor according to claim 1, wherein the coolant input and/or the coolant output of the compressor unit is or are located in a bottom part of the cooling jacket.

14. The screw compressor according to claim 1, wherein no other connections for gas or liquid are located along a vertical line directly below the coolant input and/or the coolant output of the compressor unit.

15. The screw compressor according to claim 1, wherein the coolant input and the coolant output of the compressor unit have the same dimensions.

16. The screw compressor according to claim 1, wherein the compressor mounting surface and the gearbox mounting surface are provided with dowel pins and corresponding dowel holes for the alignment of the shaft of the two helical rotors by which the gearbox is coupled in a torque-transmitting way with respect to an incoming shaft of the gearbox and/or for the alignment of the oil input, the oil output, the coolant input, and the coolant output of the compressor unit to the oil supply channel, the oil removal channel, the coolant supply channel and the coolant removal channel of the gearbox.

17. The screw compressor according to claim 16, wherein the dowel pins and dowel holes are located in a plane parallel to or coinciding with a plane through geometric axes of the two helical rotors of the compressor unit.

18. The screw compressor according to claim 1, wherein the screw compressor is an oil-free screw compressor.

19. The screw compressor according to claim 1, wherein the screw compressor is an inlet-driven screw compressor, wherein the compressor mounting surface and the gearbox mounting surface are located on the inlet side of the compressor unit.

20. A gearbox configured to be usable in a screw compressor, the gearbox comprising:

a gearbox housing with an opening, wherein a gearbox mounting surface that mates with a compressor mounting surface of a compressor unit is formed by a periphery of the opening, wherein said opening is configured to receive both ends of shafts of two helical rotors of the compressor unit, a gear that is configured to be coupled in a torque-transmitting way to a respective shaft of at least one of the two helical rotors, wherein said gearbox housing has internally integrated channels comprising an oil supply channel, an oil removal channel, a coolant supply channel, and a coolant removal channel, and wherein the oil supply channel, the oil removal channel, the coolant supply channel, and the coolant removal channel are configured to lead to or start from the gearbox mounting surface, wherein the oil supply channel is configured to be directly connected to an oil input of the compressor unit to supply oil to the compressor unit, the oil removal channel is configured to be directly connected to an oil output of the compressor unit to remove the oil from the compressor unit, the coolant supply channel is configured to be directly connected to a coolant input of the compressor unit to supply a coolant to the compressor unit, and the coolant removal channel is configured to be directly connected to a coolant output of the compressor unit to remove the coolant from the compressor unit.

* * * * *